US006012727A

United States Patent [19]

Chang

[11] Patent Number: 6,012,727

[45] Date of Patent: Jan. 11, 2000

[54] VIBRATION ABSORBER ASSEMBLY FOR THE WHEEL SEAT OF A ROLLER SKATE

[76] Inventor: Sheng-Tai Chang, No. 510, Sec. 5, Chung-Shin Rd., San-Chung, Taipei, Taiwan

[21] Appl. No.: 09/247,586

[22] Filed: Feb. 10, 1999

[51] Int. Cl.[7] ..... A63C 17/04

[52] U.S. Cl. ..... 280/11.28; 280/11.22

[58] Field of Search ..... 280/11.19, 11.22, 280/11.23, 11.27, 11.28, 87.042

[56] References Cited

U.S. PATENT DOCUMENTS 5,398,949 3/1995 Tarng ..... 280/11.22
5,575,489 11/1996 Oyen et al. ..... 280/11.22
5,685,551 11/1997 Zorzi et al. ..... 280/11.22
5,704,621 1/1998 Lazarevich et al. ..... 280/11.28

*Primary Examiner*—Richard M. Camby
*Attorney, Agent, or Firm*—Bacon & Thomas, PLLC

[57] ABSTRACT

A wheel seat for a roller skate includes a shoe, a wheel seat, multiple vibration absorbers, multiple bolts and rollers and having vibration absorbers on its wheel seat. The wheel seat connecting to the bottom of the shoe is provided on both sides of and beneath it with multiple positioning grooves for mounting the vibration absorbers which each comprises an external housing and an inner slide.

3 Claims, 4 Drawing Sheets

VIBRATION ABSORBER ASSEMBLY FOR THE WHEEL SEAT OF A ROLLER SKATE

BACKGROUND OF THE INVENTION

1. Field of the Invention

The present invention is related to an improved structure of wheel seat for a roller skate, and especially to an improved structure of wheel seat having vibration absorbers on the wheel seat of the roller skate. When in skating, the vibration absorbers absorb vibration created on the roller skate to make it smooth in skating. Such improved structure can reduce vibration in skating, maintain balance by a user and thereby increase safety of skating.

2. Description of the Prior Art

Skating is one of the most delighted activities nowadays, especially for youths. With a skate on feet, a youth can enjoy the fun of skating. Earlier skates have two front and two rear wheels on each of them, they are not accepted now for feeling and speed of them are both inferior. A user can feed no fun of them, and thereby they are not popular any more. The in-line roller skates prevailing now are better in feeling and speed in skating and thereby are popular because youths like them. In-line roller skates in the markets have a variety of types. However, the roller skates used presently have their shoes fixed directly on the wheel seats thereof. There is no elastic space between the shoes and the wheel seats, therefore, when shaking and bouncing are induced in skating, the shaking force is transferred directly to the feet of the skater. This tends to render the skater to be shaken and lose balance, and this is highly dangerous. It is hard to avoid of the chance of having small stones or small pits on skating grounds; skaters mostly do no see small stones or small pits on skating grounds and skate directly over them. Thereby shaking and bouncing are induced, the skaters will be influenced directly to decline or fall; this may induce damage if skating speed is too fast. However, small stones or small pits on skating grounds are unavoidable and are hard to clear off. Therefore, it is a problem to be solved in providing safer and more perfect skates.

SUMMARY OF THE INVENTION

In view of the aforesaid disadvantage, and in view that the exercise of skating is an excellent activity for leisure and worthy of promotion, and that the supreme utensil for skating is a pair of skates, the inventor of the present invention finally provides the improved structure of the invention after continuous study, improving, designing, development as well as repeated experiments, examination and trials based on his experience of years in producing, designing and selling products. The present invention is an improved structure of wheel seat for a roller skate having vibration absorbers on their wheel seat. Springs are hidden in the vibration absorbers to avoid the trouble of clamping something. The vibration absorbers are mounted directly on the wheel seat without assembling with other members, thereby the appearance of them is neat and more beautiful, and manufacturing and assembling of them can be more convenient.

The main object of the present invention is to provide a vibration absorber having a spring hidden therein; the spring thus is prevented from clamping something. This can increase safety of the skates, and the appearance of the wheel seat providing the vibration absorber is neat and more beautiful.

The secondary object of the present invention is to provide a vibration absorber on a wheel seat without assembling with other members, thereby manufacturing and assembling of the vibration absorber can be more convenient.

Another object of the present invention is to mount a vibration absorber in a positioning groove on a wheel seat of a skate. While the vibration absorber can be mounted in an inclined orientation in pursuance of the inclination angle of the positioning groove and the size of the shoe for increasing the distance between the front and rear wheels. Thus larger wheels can be used in order to lower the position of center of gravity of the skate and make stable of skating.

The present invention will be apparent after reading the detailed description of the structure and arrangement of the preferred embodiment thereof in reference to the accompanying drawings.

DETAILED DESCRIPTION OF THE PREFERRED EMBODIMENT

Figure 1:
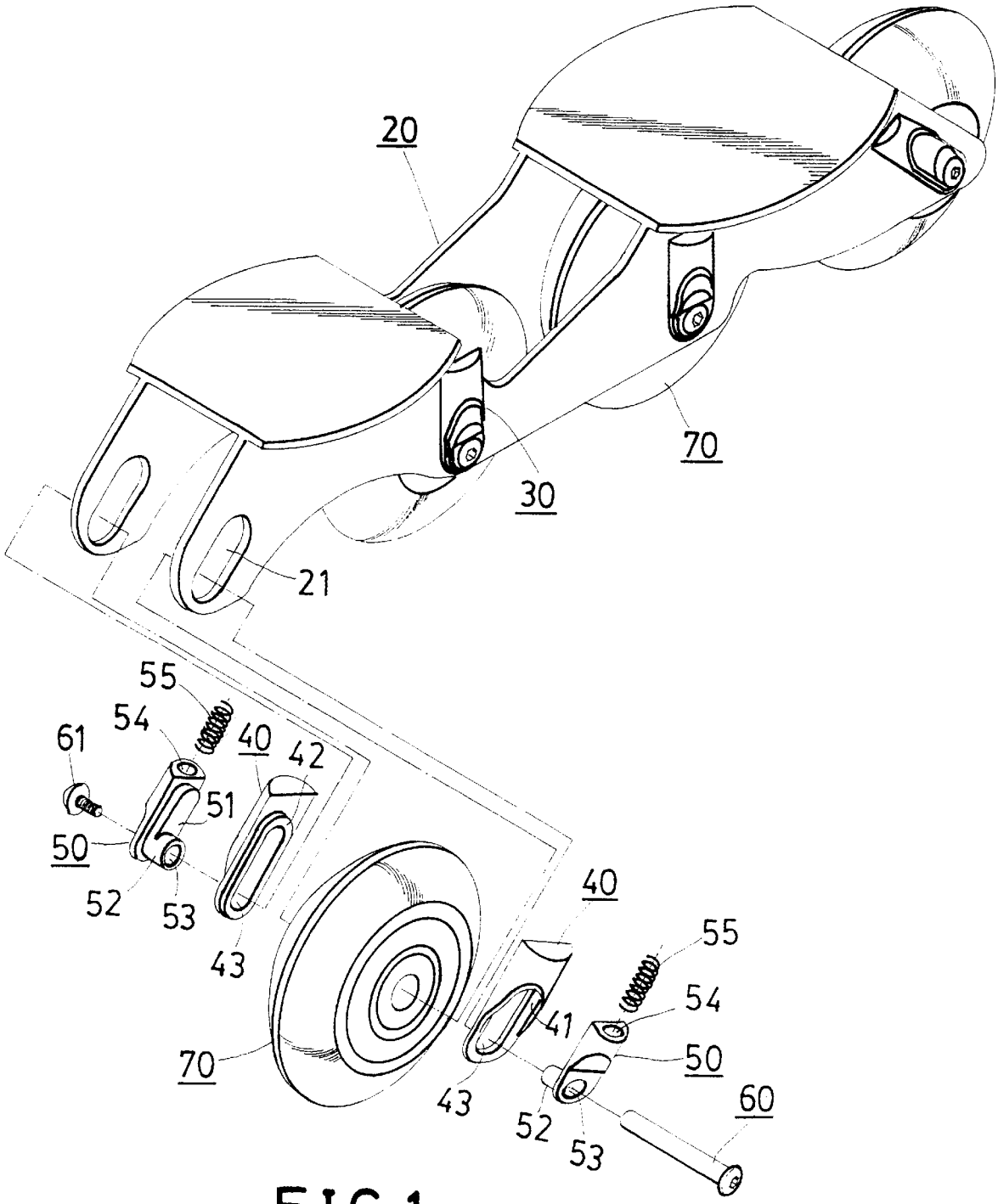
FIG. 1 is an explode perspective view showing the structure of the present invention.
Figure 2:
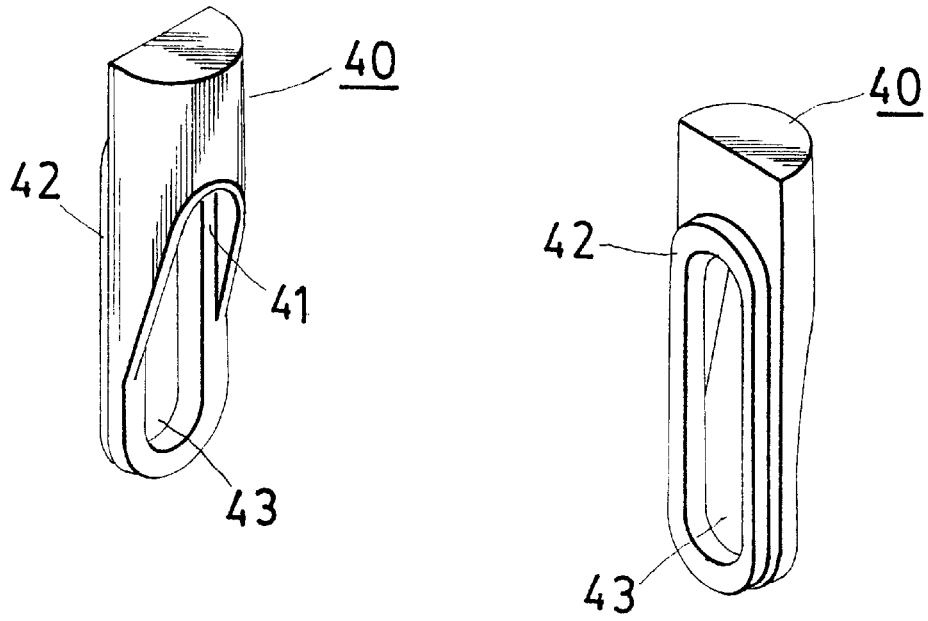
FIG. 2 includes two perspective views showing an external housing of a vibration absorber of the present invention.
Figure 3:
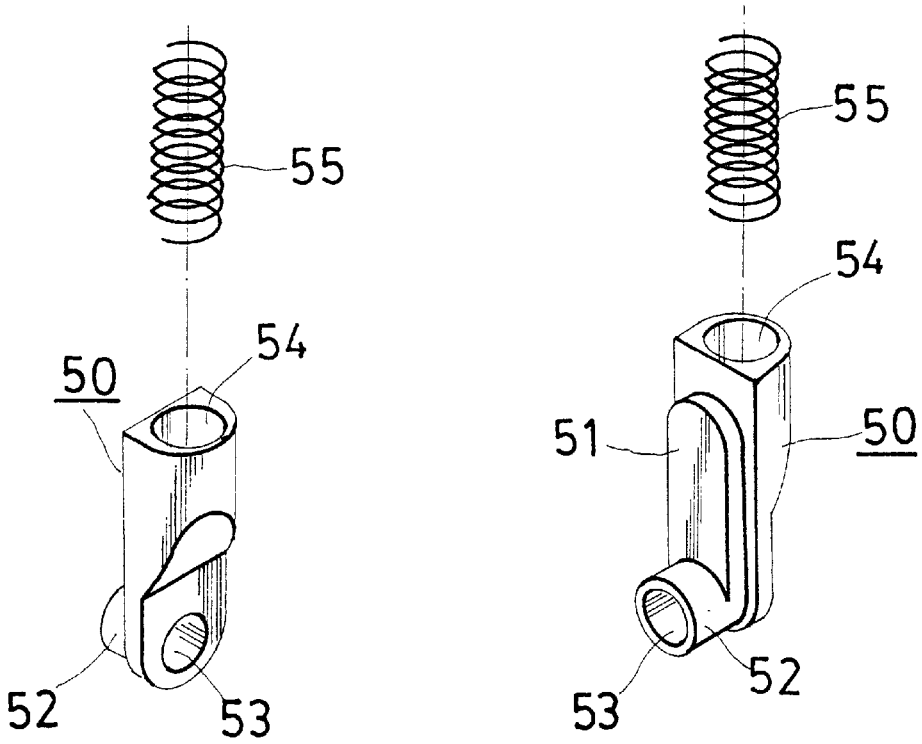
FIG. 3 includes two perspective views showing an inner slide of a vibration absorber of the present invention.

Referring in FIGS. 1, 2, 3 and 6, the present invention is comprised mainly of a shoe 10, a wheel seat 20 connecting to the bottom of the shoe 10 and being provided on both sides of and beneath it with a plurality of positioning grooves 21, a plurality of vibration absorbers 30 each being comprised of an external housing 40 and an inner slide 50 and a plurality of bolts 60 and rollers 70.

Wherein, the external housing 40 is in the form of a hood with an upper receiving chamber 41 and a lower positioning part 42 which forms a sliding slot 43. The inner slide 50 includes on an inner side thereof a slide block 51 which is provided with a lower limiting lever 52 having a round hole 53 therein. The inner slide 50 is provided on the upper portion thereof with a receiving chamber 54 having a spring 55 therein.

The inner slide 50 and its spring 55 are embedded in the upper receiving chamber 41 of the external housing 40. The slide block 51 of the inner slide 50 is inserted in the sliding slot 43 of the external housing 40 and is slidable therein. The spring 55 is hidden in the external housing 40 and the inner slide 50 to prevent from clamping something.

Figure 4:
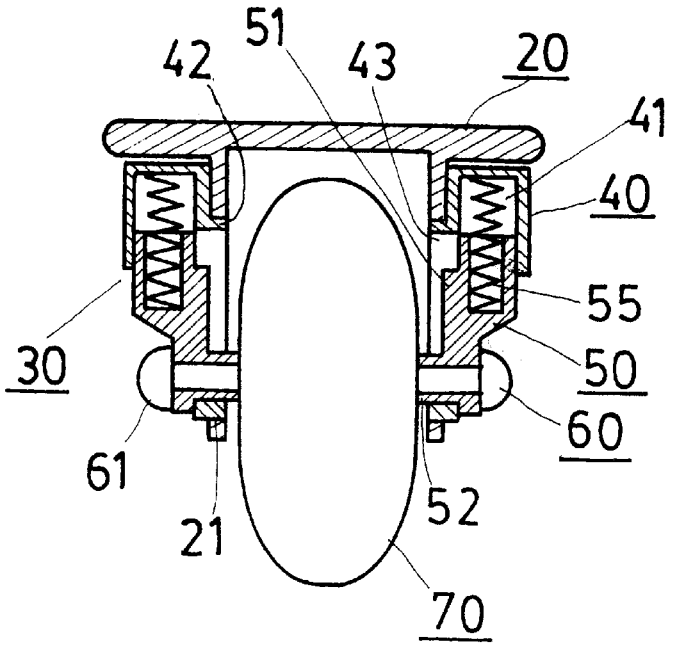
FIG. 4 is a sectional view showing the structure of the present invention.

With the above stated members, the inner slide 50 and its spring 55 are embedded in the upper receiving chamber 41 of the external housing 40 to form a vibration absorber 30 of the present invention. The vibration absorber 30 is mounted in a positioning groove 21 of the wheel seat 20 to embed the lower positioning part 42 of the external housing 40 in the positioning groove 21. A bolt 60 is inserted from the round hole 53 of the inner slide 50 of the vibration absorber 30. A roller 70 is placed on the bolt 60; then the bolt 60 is extended through another round hole 53 in the inner slide 50 of another vibration absorber 30. The lower limiting levers 52 of both the inner slides 50 of the vibration absorbers 30 now exactly abut against the lateral sides of the roller 70 (as shown in FIG. 4). Then a screw 61 is used to lock the other end of the bolt 60, and the vibration absorbers 30 and the roller 70 are fixed on the wheel seat 20.

Figure 5:
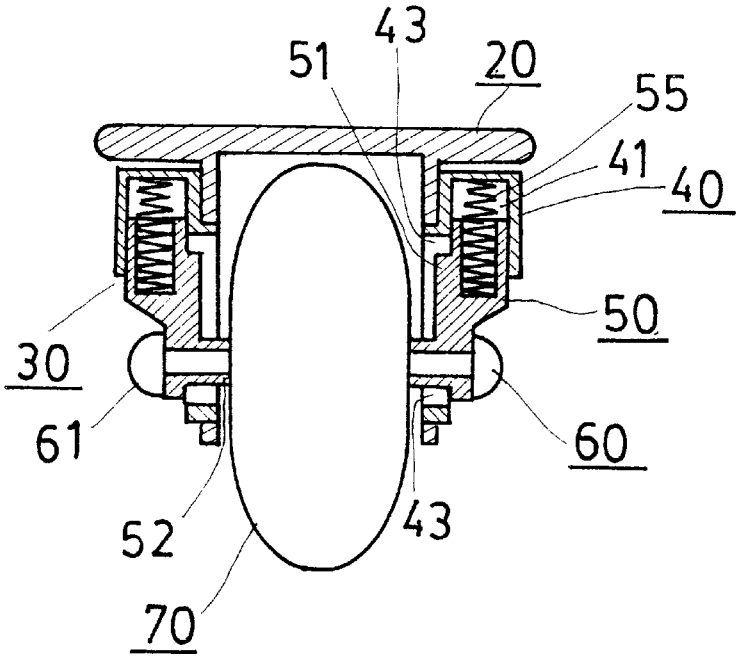
FIG. 5 is a sectional view showing the operation in the structure of the present invention.

Referring to FIGS. 4 and 5, when the wheel seat 20 of the skate progresses in skating, the rollers 70 of the skate are shaken by the rough surface of the ground, they are moved upwardly together with the inner slides 50 of the vibration absorbers 30. The slide blocks 51 of the inner slides 50 slide in the sliding slots 43 of the external housing 40, therefore, bouncing of the rollers 70 can be offset by the springs 55 between the inner slides 50 and the external housings 40. Then the inner slides 50 get back to their original positions. Hence the wheel seat 20 is not influenced to become unstable by bouncing of the rollers 70, rather, it is excellent stable. The vibration absorbers 30 hide the springs 55 therein, this can not only prevent the springs 55 from clamping something, but also make the appearance of the vibration absorbers 30 neat and more beautiful. After the wheel seat 20 is combined with the skate 10 (as shown in FIG. 6), the vibration absorbers 30 on the wheel seat 20 can make the skate 10 more stable without shaking.

Figure 6:
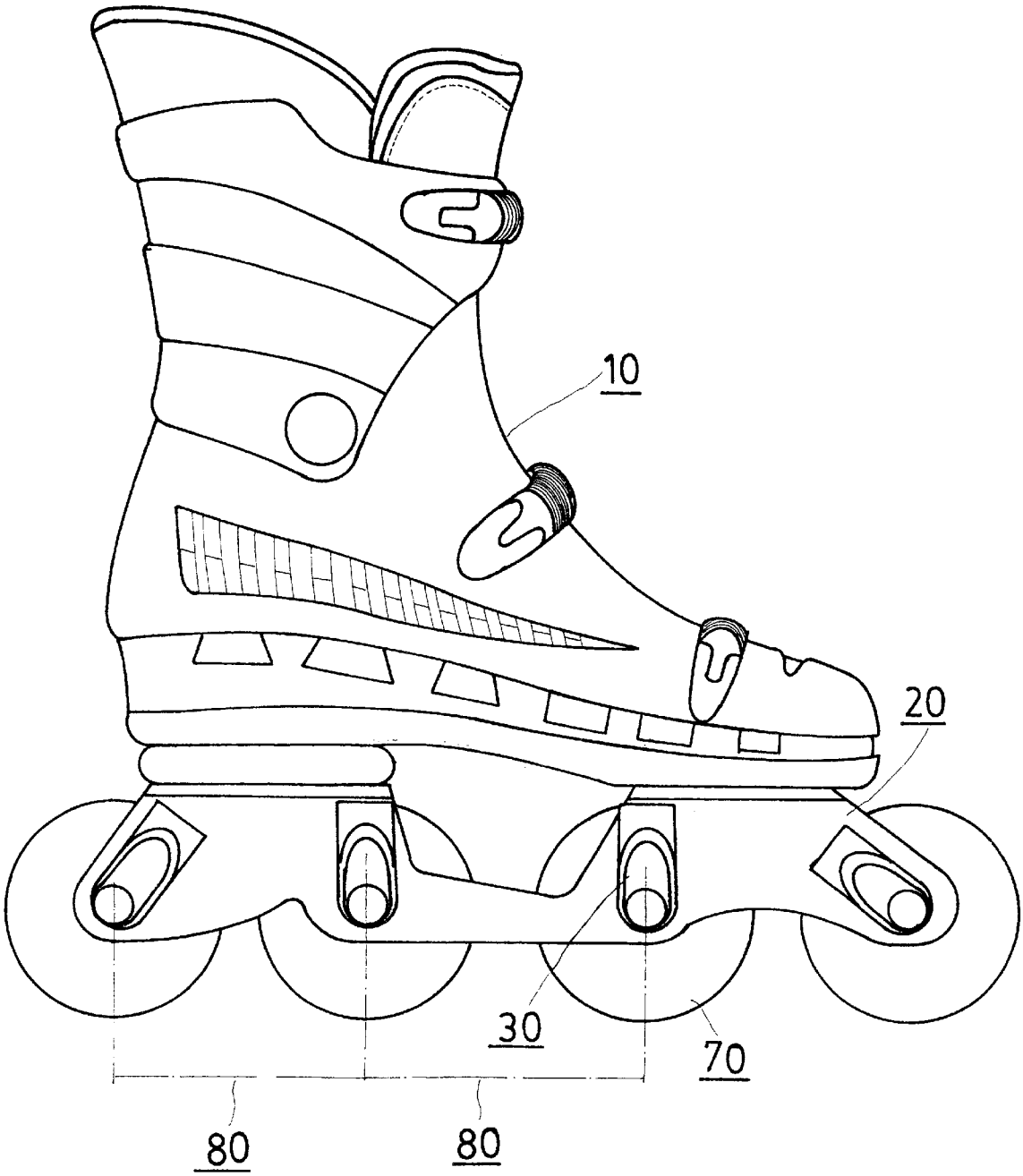
FIG. 6 is a side view showing the structure of the present invention.

Referring to FIGS. 1 and 6, each of the positioning grooves 21 beneath the wheel seat 20 is appropriately inclined to allow the distance 80 between a front and a rear one of the wheels 70 to be adjustable. Thus positions of the centers of gravity of the wheel seat 20 and the skate 10 can be adjusted, so that they can keep appropriate positions of their centers of gravity when the size of the skate 10 is changed. Besides, the vibration absorbers 30 are mounted obliquely, vibration on the wheel seat 20 and the skate 10 can be eliminated more quickly.

In conclusion, the present invention has the vibration absorbers 30 mounted on the wheel seat, so that the wheel seat of the skate 10 is provided with excellent vibration absorbing effect. The vibration absorbers 30 have the springs 55 hidden therein; this not only prevents the springs 55 from clamping something, but also make the appearance of the vibration absorbers 30 neat and more beautiful. By providing the vibration absorbers 30 on the skate 10 in the present invention, the skate 10 can also be safer in addition to its function of vibration absorbing.

Having thus described my invention, what I claim as new and desire to be secured by Letters Patent of the United States are:

1. A vibration absorber assembly for the wheel seat of a roller skate having a shoe attached to the wheel seat and a plurality of rollers, the assembly comprising:

a) a plurality of pairs of opposed positioning grooves formed in the wheel seat, each pair of grooves for receiving a roller therebetween;

b) a vibration absorber secured within each positioning groove, each absorber including an external housing, an inner slide and a spring;

c) each external housing having an upper receiving chamber, a lower positioning part engaged within the positioning groove, and a sliding slot formed in the positioning part;

d) each inner slide having a slide block at an inner side thereof, a limiting lever carried by the slide block at a lower portion thereof, a hole formed through the limiting lever, a receiving room at an upper portion of the inner slide, the spring being disposed within the receiving room; and e) the inner slide and spring being further disposed within the upper receiving chamber of the external housing and a bolt securing each pair of absorbers within each pair of positioning grooves, the bolt extending through the holes of the limiting levers and the sliding slots of the absorbers and permitting sliding movement of the inner slides within the external housings against the bias of the springs.

2. The vibration absorber assembly of claim 1, wherein the wheel seat includes a pair of inclined positioning grooves at a front portion of the seat and a pair of inclined positioning grooves at a rear portion of the seat for permitting adjustment of the rollers and the center of gravity of the wheel seat in correspondence with the size of a shoe attached to the wheel seat.

3. The vibration absorber assembly of claim 1, wherein the spring within each receiving room is concealed by the external housing.

* * * * *